US005402883A

United States Patent [19]

Shin

[11] Patent Number: 5,402,883

[45] Date of Patent: Apr. 4, 1995

[54] GOLF BAG WITH UNIQUE POCKETS AND NOVEL DIVIDER

[76] Inventor: Byung Shin, 9413 Warbler Ave., Fountain Valley, Calif. 92708

[21] Appl. No.: 9,724

[22] Filed: Jan. 27, 1993

[51] Int. Cl.[6] ..... A63B 55/00

[52] U.S. Cl. ..... 206/315.3; 206/315.4; 206/315.5; 206/315.6

[58] Field of Search ..... 206/315.3–315.6, 206/315.7, 315.8

[56] References Cited

U.S. PATENT DOCUMENTS

| | | | |
|---|---|---|---|
| 1,676,592 | 7/1928 | White | 206/315.5 |
| 1,899,825 | 2/1933 | Reach | 206/315.4 |
| 2,256,521 | 9/1941 | Kirkpatrick et al. | 206/315.4 X |
| 2,751,955 | 6/1956 | Nahon | 206/315.4 X |
| 2,820,498 | 1/1958 | Endee | 206/315.5 X |
| 3,259,160 | 7/1966 | Penna | 206/315.5 |
| 4,142,563 | 3/1979 | Ackerfeldt et al. | 206/315.5 |
| 4,266,589 | 5/1981 | Cochran | 206/315.5 X |
| 4,282,912 | 8/1981 | Brown | 206/315.6 X |
| 4,767,001 | 8/1988 | Kim | 206/315.3 |
| 4,768,650 | 9/1988 | Chancellor, Jr. | 206/315.3 |
| 4,779,725 | 10/1988 | Gerber | 206/315.5 X |
| 4,881,638 | 11/1989 | Cho | 206/315.3 |
| 4,905,827 | 3/1990 | Kim | 206/315.5 X |
| 4,984,684 | 1/1991 | Conner et al. | 206/315.3 |
| 5,148,915 | 9/1992 | Ryan | 206/315.3 X |
| 5,176,253 | 1/1993 | Perrin et al. | 206/315.5 |
| 5,222,598 | 6/1993 | Yamazoe | 206/315.5 |

FOREIGN PATENT DOCUMENTS 780347 7/1957 United Kingdom ..... 206/315.3

*Primary Examiner*—Sue A. Weaver

*Attorney, Agent, or Firm*—John J. Connors

[57] ABSTRACT

Disclosed is a golf bag 10 including unique pockets 50 and 52 and a novel divider member 110. The bag 10 employs an enlarged, elongated hollow main club holding tube 12 having a predetermined length slightly less than the length of a typical golf club, opposed sides, an open top end, and a closed bottom end. The pockets 50 and 52 are on a side of the tube opposite a shoulder strap 20 and aligned in a row, with the upper pocket 50 disposed substantially directly above the lower pocket 52 when the bag 10 is upright. The enlarged pockets 50 and 52 each have a box-like configuration with a back 58 adjacent the tube, a pair of sides 54 and 56 generally parallel to each other and each having generally the same configuration with edges that are generally parallel to each other, and a front wall 60 disposed between the sides and having opposed edges which are generally parallel to each other. Each edge of the front wall is connected to one edge of an adjacent side by a zipper mechanism 76. Each side 54 and 56 is flexible to allow the sides to be manually bent outward. The divider member 110 is within the tube 12 and it divides the tube into a plurality of different club holding sections. The divider member 110 includes a bag element 112 having a bottom wall 114 attached to the bottom of the tube 12.

12 Claims, 6 Drawing Sheets

GOLF BAG WITH UNIQUE POCKETS AND NOVEL DIVIDER

BACKGROUND OF THE INVENTION

1. Field Of The Invention

This invention relates to a golf bag, and particularly, one having a unique pockets arrangement and an easy to assembly a divider member.

2. Background Discussion

Golf bags are conventional devices used to carry golf clubs and the employ a main club holding tube which has a length approximately equal to, or slightly less, than the shaft length of conventional golf clubs. The golf clubs are placed in the tube, which usually includes dividers to segregate woods from irons and the different irons into separate sections. Ideally, the divider should be easy to assemble, so that the time and labor need to manufacture the bag is reduced. Also, the divider should protect against scratching the shafts of the golf club. This is particularly important when golf clubs with graphite shafts are to be stored in the bag. Graphite shafts are subject to damage by scratching, and special measures should be taken to minimize the likelihood of such damage. Typically, golf bags also have a number of pockets disposed on the outside of the tube that enable the golfer to store sweaters and jackets, golf tees, golf balls, and other golf paraphernalia. Pockets which are more conveniently accessed and store items neatly is desirable.

SUMMARY OF THE INVENTION

It is the objective of this invention to provide a golf bag with a unique pocket design and an easy to assemble divider member that protects against scratching graphite shafts. The golf bag employs a conventional enlarged, elongated hollow main club holding tube having a predetermined length slightly less than the length of a typical golf club, opposed sides, an open top end, and a closed bottom end. The pockets are one the exterior of the tube and the divider member is within the tube, and provides different sections for storage of golf clubs.

The golf bag of this invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENT," one will understand how the features of this invention provide its advantages, which include easy access to the interior of pockets, ease of manufacture, convenience and versatility, and protection of graphite shafts.

The first feature of the golf bag of this invention is the pocket design. At least one enlarged pocket is used which has a box-like configuration with a back adjacent the main club holding tube, a pair of sides generally parallel to each other and each having generally the same configuration with edges that are generally parallel to each other and in registration, and a front wall disposed between the sides and having opposed edges which are generally parallel to each other. Each edge of the front wall is connected to one edge of an adjacent side by a zipper mechanism. The front wall of each pocket has a top and a bottom connected to the tube. The sides are flexible to allow each side to be manually bent outward along a linear segment of each side that is adjacent and substantially parallel to the tube to expose an internal surface of each side upon being bent outward.

Preferably, two pockets are used, an upper pocket and a lower pocket, both on the same one side of the club holding tube. These pockets will normally be on the side of the tube opposite a conventional shoulder strap. The pockets are aligned in a row, with the upper pocket disposed substantially directly above the lower pocket when the bag is upright. The upper pocket preferably has a volumetric capacity which is less than that of the lower pocket, and lower pocket has along the back a garment hanging strap. Preferably, at least the lower portion of the exterior of the lower pocket has a protective covering.

In one embodiment, the upper and lower pockets present a side view that has substantially a B-shaped configuration. The upper and lower pockets are disposed relative to each other so that the bottom of the front wall of the upper pocket is immediately adjacent to the top of the front wall of the lower pocket, and the combined length of the upper and lower pockets is in excess of 90 percent of the length of the tube. Preferably, the internal surfaces of the sides of the lower pocket each have a shoe holding compartment that allows a single shoe to be store therein.

The second feature is a pocket assembly on the one side of the tube below the shoulder strap. This pocket assembly includes a removable pouch that has a hook section of a hook and fabric type connector on an outer portion that enables the pouch to be removably fastened to an interior fabric wall of the pocket assembly. Preferably, the pocket assembly has a detachable front flap.

The third feature is a detachable divider member within the tube that divides the tube into a plurality of different club holding sections The novel divider member of this invention includes a bag element having an open top, side walls, and a bottom wall connected to the side walls. One element of another hook and fabric type fastener is attached to the exterior of the bottom wall, and the other element of this hook and fabric type fastener is attached to the interior of the bottom end of the tube, enabling the bag element to the removably attached to the tube. A support member connects the open top of the bag element to the open top end of the tube, with the sides of the bag element extending lengthwise along substantially the entire length of the tube, so that the hook element engages the fabric element upon assembly when the bag is inserted into the tube.

The fourth feature is that the support member includes at least one flap member near the open top of the bag element having one element of a third hook and fabric type fastener attached to a portion of the flap near the open top of the bag element, and the other element of the third hook and fabric type fastener attached to a portion of the flap remote from the one element. During assembly, the flap is initially in an unfolded condition, and then it is folded upon itself into a loop. Specifically, the flap is wrapped around a rigid structure extending across the open top end of the tube, folded inward upon itself to engage the locking elements of the third hook and fabric type fastener. Preferably, a cross-element such as, for example, a steel bar, is beneath, and engages, the rigid structure to provide support. To protect graphite shafts, the exterior of the loop and the cross-element are covered with is a scratch resistant material, such as a fur or fur-like material.

The fifth feature is that an upper and a lower row of snaps for attaching a hood over the open top of the tube are disposed near the open top of the tube. These snaps provide a raised and a lowered hood position. The raised position provides space for extra long golf clubs.

The pocket features of the golf bag of this invention facilitates carrying a variety of items including golf shoes located in-the compartments in the sides of the lower pocket, and golf apparel such as jackets and sweater which may be hung neatly on the strap inside the lower pocket. The features of the divider member renders the golf bag easy to assemble and protects against scratching graphite shafts.

BRIEF DESCRIPTION OF THE DRAWING

The preferred embodiment of this invention, illustrating all its features, will now be discussed in detail. This embodiment depicts the novel and non-obvious golf bag of this invention shown in the accompanying drawing, which is for illustrative purposes only. This drawing includes the following figures (FIGS.), with like numerals indicating like parts:

FIG. 1B is a perspective view of the shoulder strap which is attached to the golf bag shown in FIG. 1.

DETAILED DESCRIPTION OF THE PREFERRED EMBODIMENT

Figures 1, 1A:
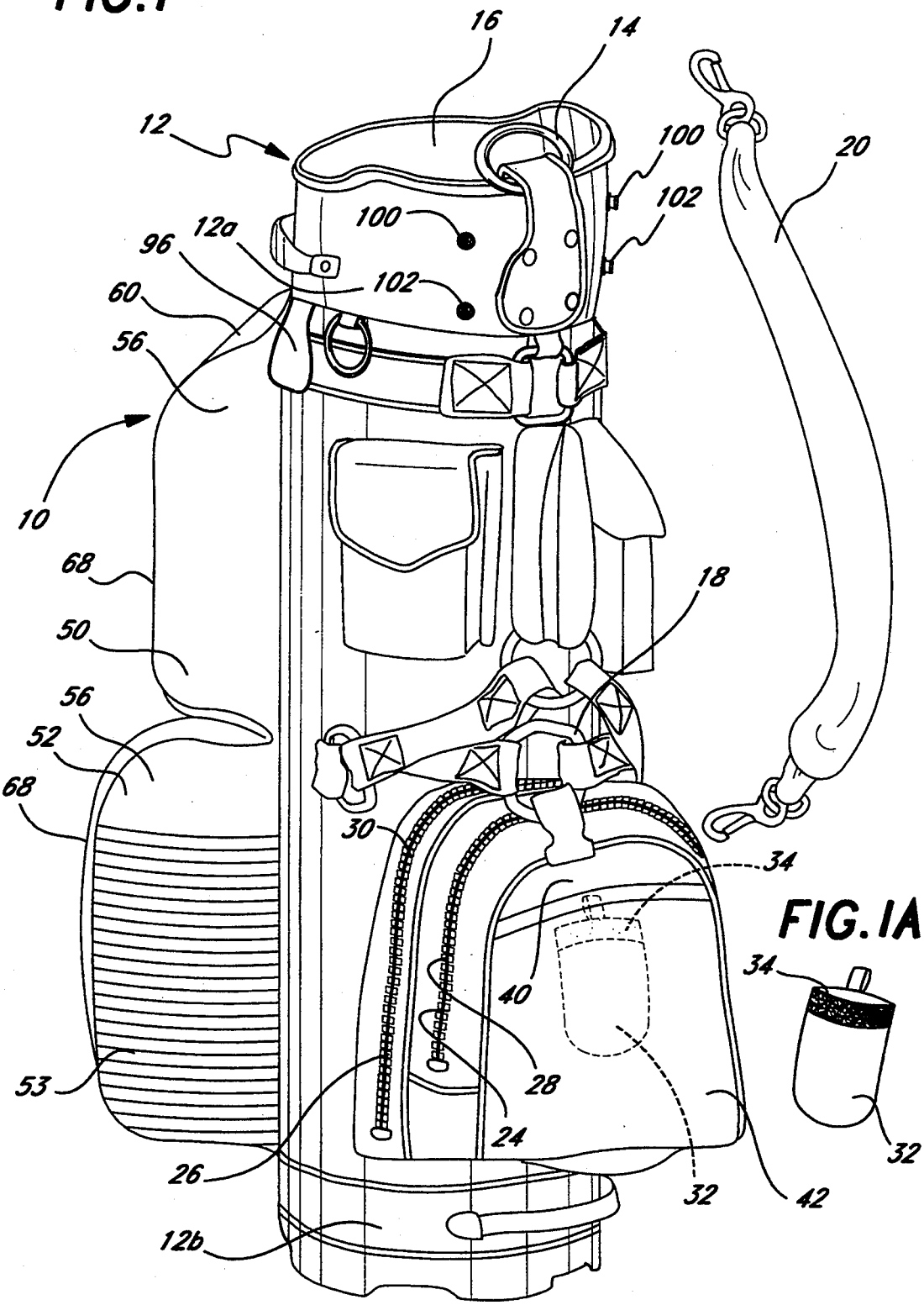
FIG. 1 is a perspective view of the golf bag of this invention.
FIG. 1A is a perspective view showing a pouch included in the pocket assembly of the golf bag shown in FIG. 1.
Figure 2:
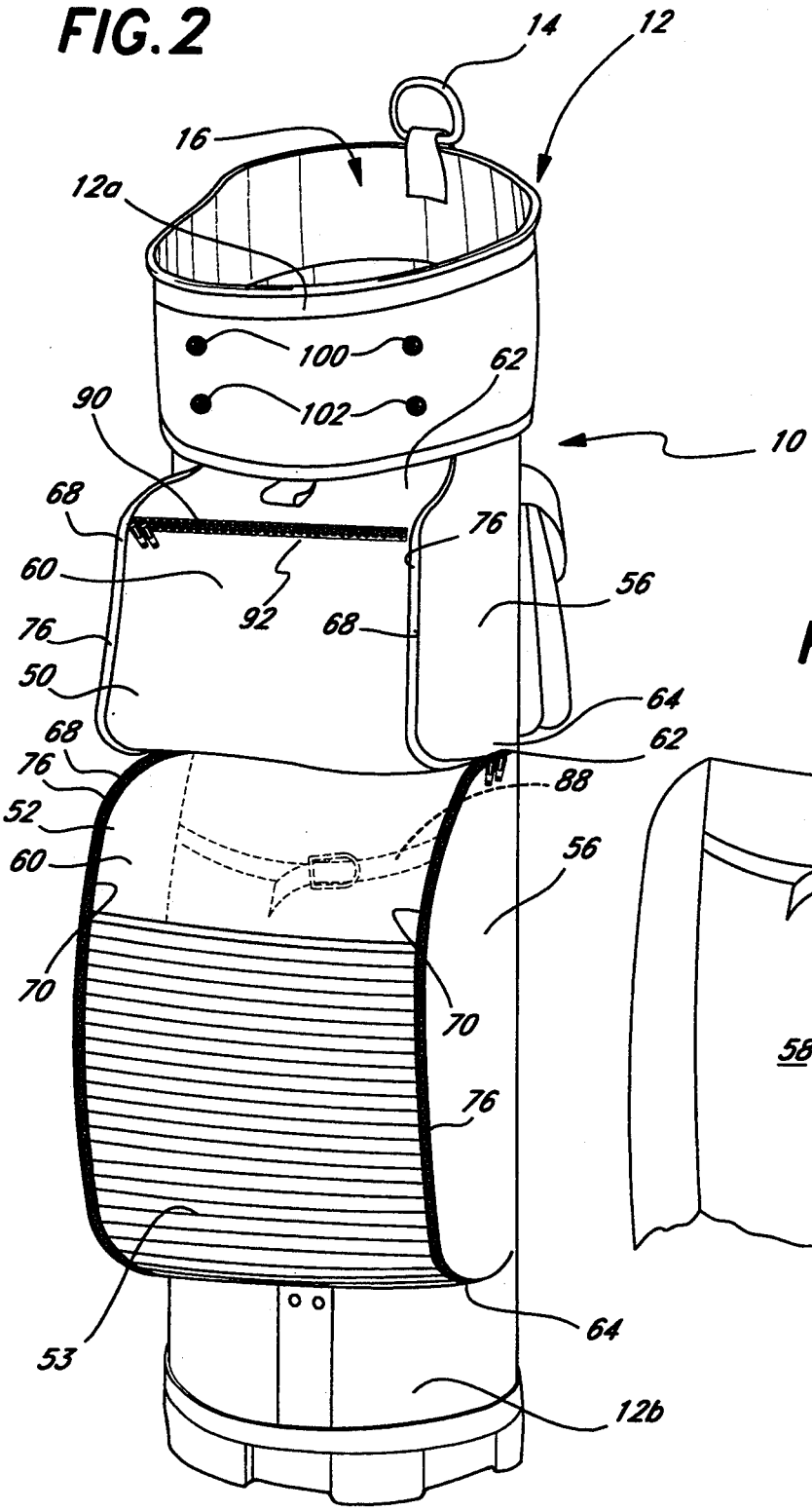
FIG. 2 is a perspective view showing the lower and upper pockets attached to the main club-holding tube of the golf bag.
Figures 3, 3A:
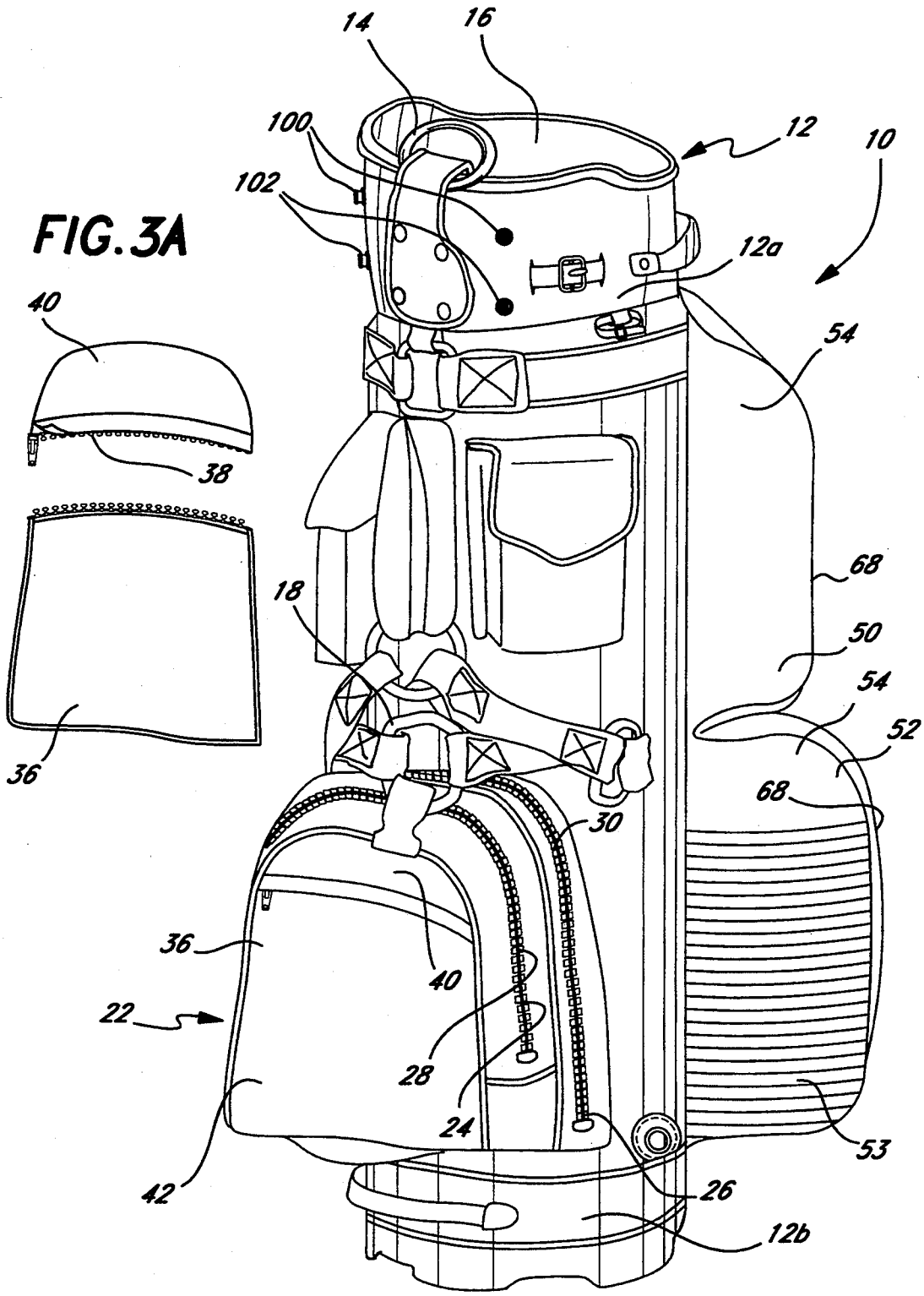
FIG. 3 is another perspective view of the golf bag of this invention.
FIG. 3A is a side-elevational view showing the removal front flap of the front pocket assembly.

As best shown in FIGS. 1 through 3, the golf bag 10 of this invention includes a main club holding tube 12 which has a length approximately equal to, or slightly less, than the shaft length of a conventional golf club, for example, a driver. The tube 12 may be made of a rigid plastic material with end caps **12*a* and 12*b* sewn or otherwise attached to the plastic material, and its exterior may be covered with a water-resistant fabric such as nylon. It has a ring 14 at the open top 16 of the tube 12 and a ring 18 at an intermediate portion along the tube's side wall that allows a conventional shoulder strap 20 (shown detached) to be attached removably at opposed ends respectively to these rings 14 and 18**.

Below the ring 18 on the front of the tube 12 is a pocket assembly 22 which is made of a fabric such as nylon and has a pair of openings 24 and 26 that provide access to the interior of the pocket assembly. Each of these openings 24 and 26 have zipper mechanisms 28 and 30, respectively, associated with them that allows the opening to be closed and opened as desired. In accordance with one feature of this invention, a pouch 32 (shown in phantom lines in FIG. 1) with the hook element 34 of a conventional hook-and-fabric-type fastener, such sold by VELCRO Corporation, is mounted in the interior of the pocket assembly by simply pressing the hooks (not shown) of the hook element 34 against the internal fabric wall of the pocket assembly 22 to hold the pouch secure to the internal wall. The pouch 32 is used to store valuables, such a money and jewelry.

In accordance with another feature of this invention as depicted in FIGS. 3 and 3A, the pocket assembly 22 may include a removable front flap 36. The front flap 36 is attached by a zipper mechanism 38 to a cover element 40 that covers an open pocket 42 on the front wall of the pocket assembly 22. It is desirable to have easy removal of the front flap 36 to allow this flap (which is preferably made of a fabric) to be embroidered with, for example, the insignia of the golf club or the name of an individual golfer.

Figure 2A:
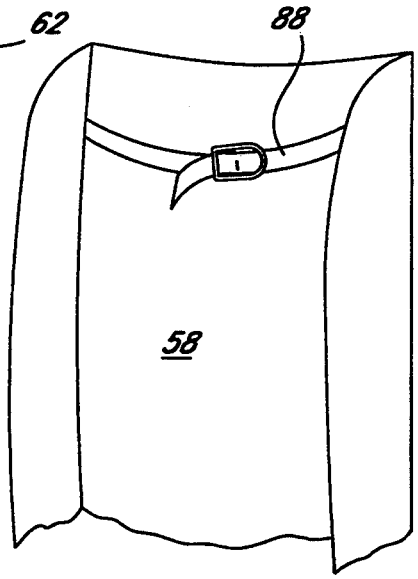
FIG. 2A is a view in perspective, illustrating an internal strap used to hang garments in the lower pockets shown in FIG. 2.
Figure 4:
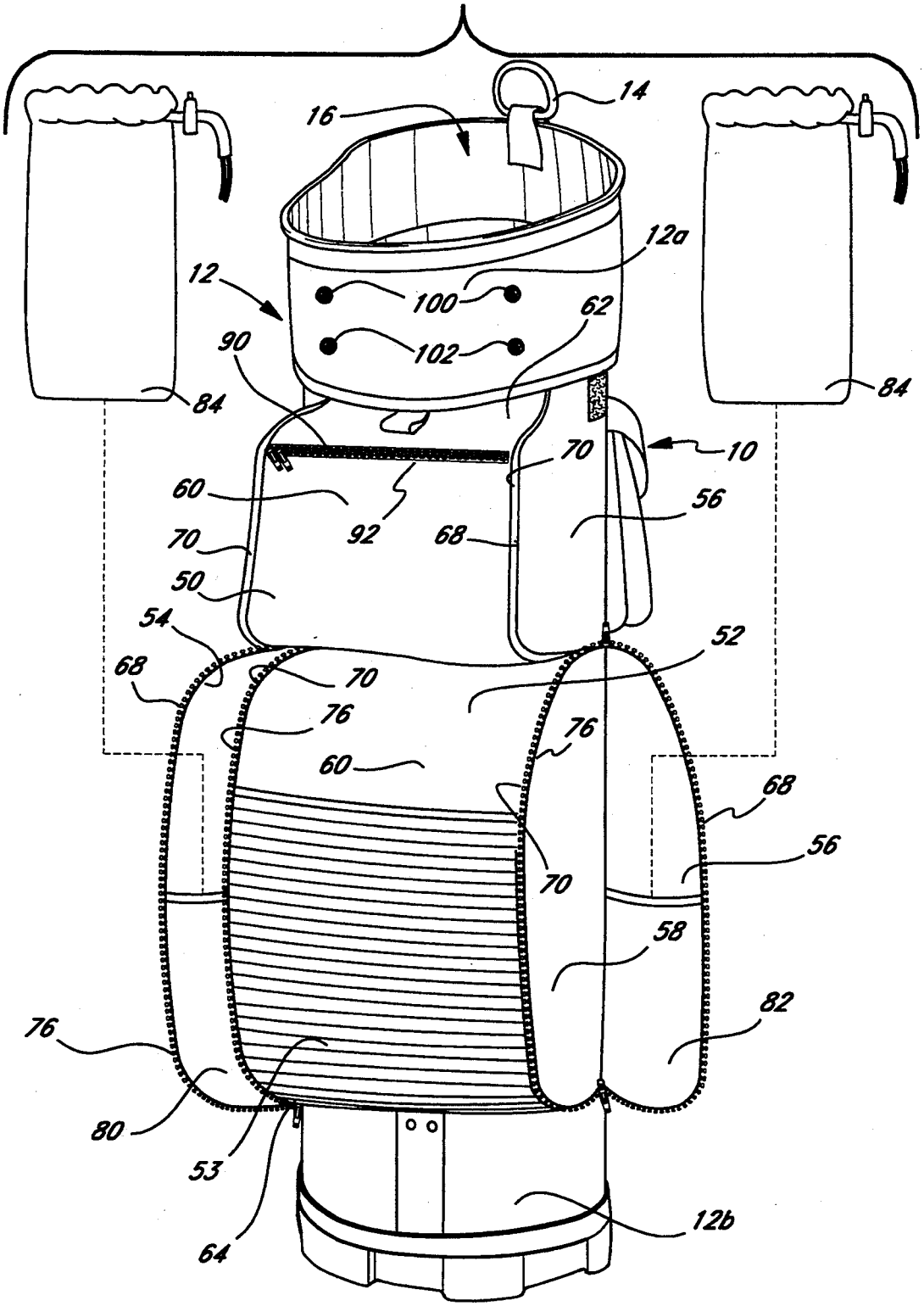
FIG. 4 is a perspective view similar to that shown in FIG. 2 with the sides of the lower pocket being bent outward, illustrating the internal shoe compartments in the sides.
Figure 5:
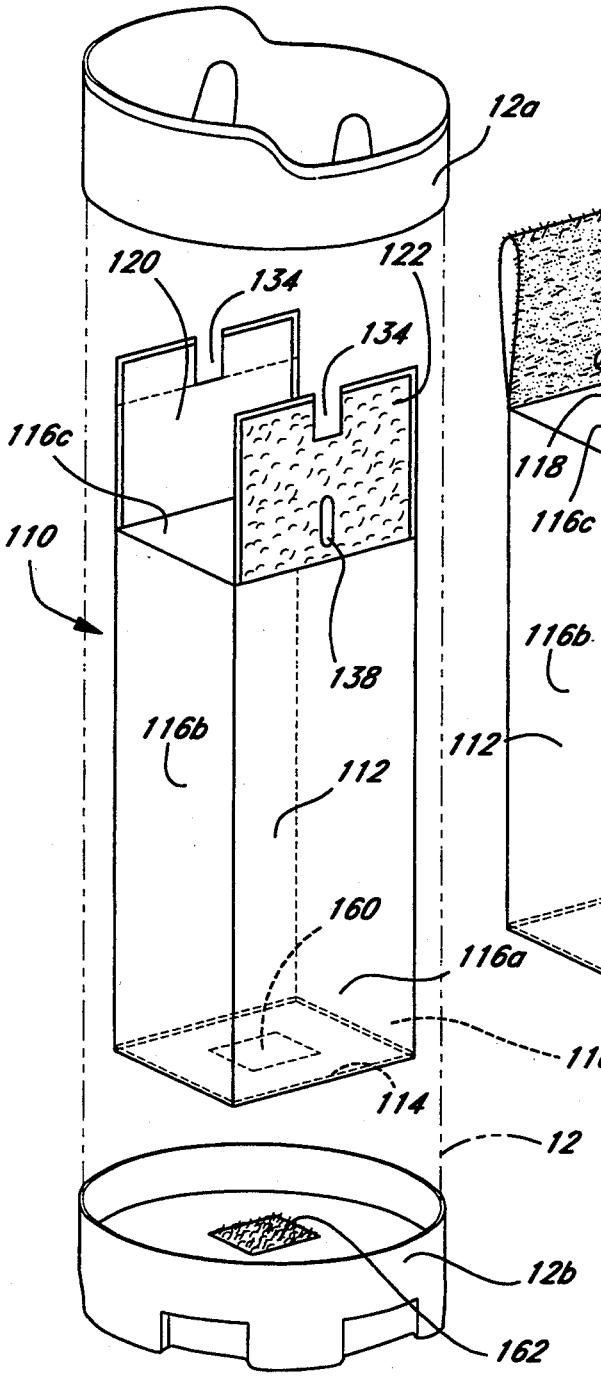
FIG. 5 is an exploded perspective view showing the construction of the novel divider member of this invention.

As best shown in FIGS. 2 and 4, the side of the tube 12 opposite the strap 20 has an upper pocket 50 and a lower pocket 52 attached to the wall of the tube. Each pocket 50 and 52 is of similar configuration, except the upper pocket 50 has a slightly lower volumetric capacity than the lower pocket 52. Each pocket 50 and 52 is enlarged and has a generally box-like configuration with opposed sides 54 and 56, a back 58 (FIG. 4) which is coextensive with the exterior of the tube 12, and a front wall 60 which has a top end 62 secured to the side of-the tube and a bottom end 64 secured to the side of the tube. The sides 54 and 56 of each pocket 50 and 52 are parallel to each other, and each have an edge 68 which is of substantially the same configuration as the edge of the other side. Opposed edges 68 are in registration with one another. The front wall 60 has opposed, parallel edges 70 which are parallel to the adjacent edges 68 of the sides 54 and 56. A zipper mechanism 76 along adjacent edges 54 and 56 and the adjacent edges 70 of the front wall 60 attaches the front wall to the sides to form the pocket when closed, and upon unzipping provide easy access to the interior of the pocket. This enables the sides 54 and 56 to be manually bent outward, as depicted in FIG. 4, along a linear segment which is adjacent the side of the tube 12 and generally parallel to the longitudinal axis of the tube. There are internal compartments 80 and 82, respectively, in the sides 54 and 56 of the lower pocket 52 which are adapted to hold shoes (for example, golf shoes stored in shoe bags 84). The lower pocket 52 has a substantial portion of the lower section of its exterior wall covered with protective material 53 such as a laminated layer of rubber bonded to the sides 54 and 56 and front wall 60. This material 53 prevents damage to the bag 10. As illustrated in FIG. 2A, the lower pocket 52 preferably has an internal strap 88 along its back 58, which allows garments to be hung in the pocket and held in position.

The upper pocket 50 is similarly constructed to the lower pocket 52, but, it additionally includes a pocket section 90 which has a zipper closure mechanism 92 generally at a right angle with respect to the zipper mechanisms 76 along the opposed edges 68 of the upper pocket. As best illustrated in FIG. 3, when looking at the side of the bag 10, the pockets 50 and 52 present a B-shape configuration. This is a distinctive feature of this invention, since many prior art bags only employ a single large pocket extending substantially the entire length of the tube 12. In contrast, the pockets 50 and 52 are in a row, one directly above the other, and they jointly extend along more than 90 percent of the length of the tube 12.

There may, for example, be a hook element 96 of a hook-and-fabric-type fastener attached near the open top end 16 of the tube 12 adjacent the upper pocket 50 for holding, for example, a golf glove (not shown). Preferably, there are two rows 100 and 102 of snaps surrounding the open top 16, which enable a hood (not shown) with complementary snaps (not shown) to be removably attached to the bag 10. If a long club is placed in the bag 10, the hood is connected to the upper row 100 to accommodate the longer shaft.

Figure 6:
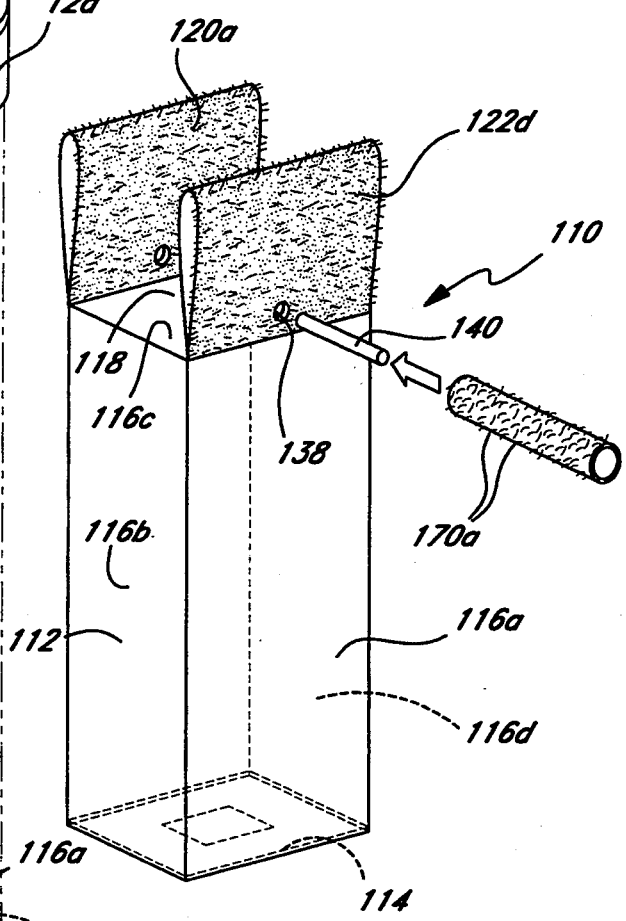
FIG. 6 is a perspective view of the divider member, with flaps folded inward to from loops, and a cross-element being inserted into aligned opening in the loops.
Figure 7:
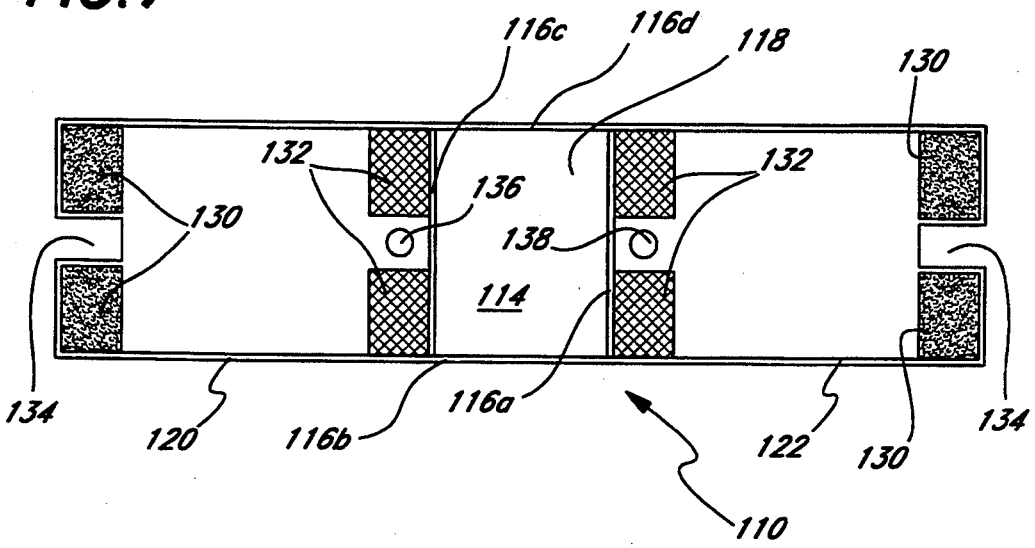
FIG. 7 is a plan view of the top of the divider member with the flaps in an unfolded condition prior to assembly.

As illustrated in FIGS. 5 through 9, an easy to assemble divider 110 is adapted to be easily attached to the tube 12. This divider 110 comprises a bag-like element 112 having a generally box-like configuration with a closed bottom 114, four rectangular side walls 116*a*, 116*b*, 116*c*, and 116*d*, an open top 118, and, at opposed edges of the side walls 116*a* and 116*c*, two outward protecting flaps 120 and 122, which are folded upon themselves to form, respectively, a pair of opposed loop sections 120*a* and 122*a* (FIG. 6). Each flap 120 and 122 has complementary locking elements 130 and 132 of a hook-and-fabric type fastener attached to opposed sides of the flaps. There are aligned slots 134 in the outer sides of each flap 120 and 122, and a pair of opening 136 and 138 straddling the open top 118 of the bag-like element 112. A cross element 140 is beneath the loop sections 120*a* and 122*a* extending cross-wise under and engaging a pair of rigid support bars 150 and 152 in the open end cap 12*a*. The cross-element has a length about equal to the diameter of the open cap 12*a*. The bars 150 and 152 are formed during molding of the end cap 12*a*, which preferably is a rigid plastic material, and they may be reinforced with steel inserts. The bars 150 and 152 support the bag element 112 in an upright position when it is inserted into the tube 12.

Figure 8:
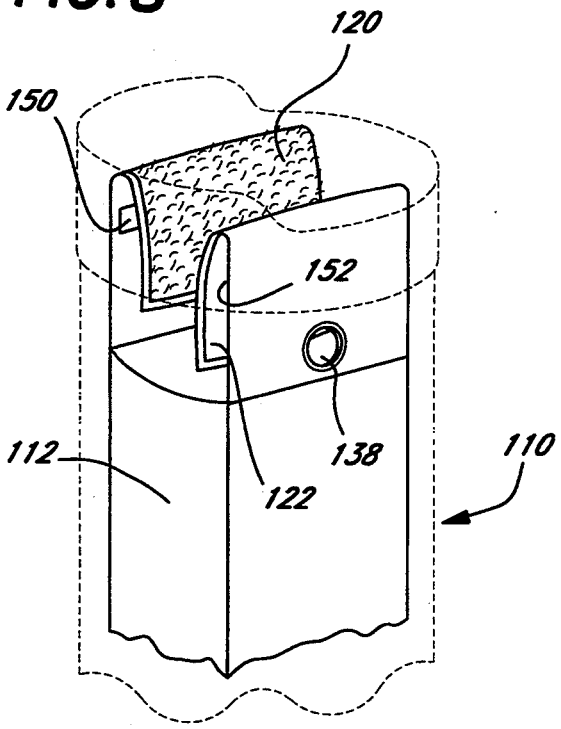
FIG. 8 is a perspective view of the divider being inserted into the club holding tube and the flaps being folded inward.
Figure 9:
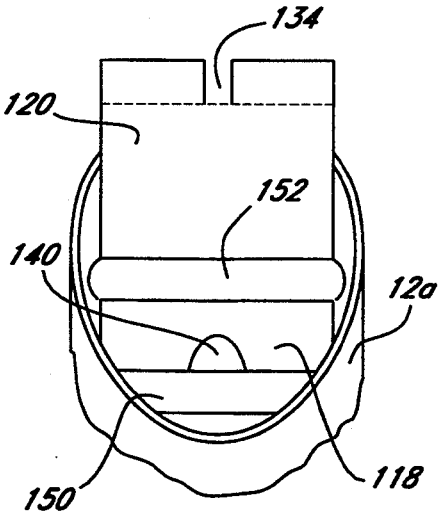
FIG. 9 is a perspective view showing the divider member inserted into the tube and only one flap unfolded and positioned to form a loop wrapped around a rigid structure extending across the open top end of the tube.

FIGS. 8 and 9 best depict how the divider member 110 is assembled. First, the bag element 112 is inserted into the open end of the tube, using a long rod to insure that the bottom 114 is pressed against the inside surface of the bottom cap 12*b*. The bottom 114 of the bag element 112 has one element 160 of a hook-and-fabric-type fastener attached to it so that this bottom may be removably attached to the inside surface of the bottom of the cap 12*b*, which has a counterpart locking element 162 of the hook-and-fabric-type fastener. The locking elements 160 and 162 engage to attach the bottom 114 of the bag element 112 to the end cap 12*b*.

Second, the flaps 120 and 122 are folded inward and wrapped, respectively, around the bars 150 and 152 as shown in FIG. 6, and the locking elements 160 and 162 are pressed together. The fur surfaces 120*a* and 122*a* are exposed and will rub against the shafts of golf clubs inserted into the divider member 110. The cross-element 140 is placed in a sheath 170 with a furry exterior 170*a* to protect club shafts, and then this assembly is inserted into the aligned openings 136 and 138 beneath and engaging the bars 150 and 152. The cross-element is flexible to allow it to be inserted as described.

Scope of the Invention

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention:

It is claimed:

1. A golf bag including an enlarged, elongated hollow main club holding tube having a predetermined length slightly less than the length of a typical golf club, opposed sides, an open top end, and a closed bottom end, a strap on one side of the tube having one end attached near the open top end and another end attached to an intermediate portion of the tube on said one side, and a pocket assembly on the other side of the tube opposite the strap, said pocket assembly including an upper pocket and a lower pocket aligned in a row, with the upper pocket disposed substantially directly above the lower pocket when the bag is upright, said upper and lower pockets presenting a side view that has substantially a B-shaped configuration, each pocket having a box-like configuration with a back adjacent the tube, a pair of sides generally parallel to each other, a front wall disposed between said sides and having a top and a bottom connected to the tube, each side having a linear segment that is substantially parallel to and attached to the tube, with said sides each being flexible to allow each side to be manually bent outward along said linear segment to expose an internal surface of each side upon being bent outward, each side having the same general configuration with side edges that are generally parallel to each other, with each side edge having a top portion, a bottom portion, and an intermediate portion between said top portion and bottom portion, said front walls each having opposed front wall edges which are generally parallel to each other, each front wall edge having a top portion, a bottom portion, and an intermediate portion between said top portion and bottom portion, with said front wall edge portions having a configuration substantially the same as the top portion, bottom portion, and intermediate portion of the side edges, and a zipper mechanism connecting each of said front wall edges to one side edge of an adjacent side of the pocket.

2. The golf bag of claim 1 where the upper pocket has a volumetric capacity less than that of the lower pocket.

3. The golf bag of claim 1 including an additional pocket assembly on said one side of the tube below the strap.

4. The golf bag of claim 1 where the pocket assembly includes a removable pouch that has on an outer portion of the pouch a hook section of a hook and fabric type connector that enables the pouch to be removably fastened to an interior fabric wall of the pocket assembly.

5. The golf bag of claim 1 where the pocket assembly has a detachable front flap, and means for removably fastening said flap on one of the front walls of the pocket assembly.

6. The golf bag of claim 1 where the upper and lower pockets are disposed relative to each other so that the bottom of the front wall of the upper pocket is immediately adjacent to the top of the front wall of the lower pocket, and the combined length of the upper and lower pockets is in excess of 90 percent of the length of the tube.

7. The golf bag of claim 1 where the internal surfaces of the sides each have a shoe holding compartment that allows a single shoe to be store therein.

8. The golf bag of claim 1 where the lower pocket has along the back a garment hanging strap.

9. The golf bag of claim 1 including a divider member within the tube that divides the tube into a plurality of different club holding sections, said divider member including a bag element having an open top, side walls, and bottom wall connected to the side walls, one element of a second hook and fabric type fastener attached to the exterior of the bottom wall, and the other element of said second hook and fabric type fastener attached to the interior of the bottom end of the tube, enabling the bag element to the removably attached to the tube, and a support member connecting the open top of the bag element to the open top end of the tube, with the sides of the bag element extending lengthwise along substantially the entire length of the tube.

10. The golf bag of claim 1 where at least the lower portion of the exterior of the lower pocket has protective covering.

11. The golf bag of claim 1 where there is an upper and a lower row of snaps for attaching a hood over the open top of the tube, providing a raised and a lowered hood position.

12. A golf bag including an enlarged, elongated hollow main club holding tube having a predetermined length slightly less than the length of a typical golf club, opposed sides, an open top end, and a closed bottom end, a pocket attached to one of said sides of the tube having a box-like configuration with a back adjacent the tube, a pair of sides generally parallel to each other, a front wall disposed between said sides and having a top and a bottom connected to the tube, each side having a linear segment that is substantially parallel to and attached to the tube, with said sides each being flexible to allow each side to be manually bent outward along said linear segment to expose an internal surface of each side upon being bent outward, each side having the same general configuration with side edges that are generally parallel to each other, with each side edge having a top portion, a bottom portion, and an intermediate portion between said top portion and bottom portion, said front wall having opposed front wall edges which are generally parallel to each other, each front wall edge having a top portion, a bottom portion, and an intermediate portion between said top portion and bottom portion, with said front wall edge portions having a configuration substantially the same as the top portion, bottom portion, and intermediate portion of the side edges, and a zipper mechanism connecting each of said front wall edges to one side edge of an adjacent side of the pocket.

* * * * *